US010584922B2

(12) United States Patent
Herring et al.

(10) Patent No.: US 10,584,922 B2
(45) Date of Patent: Mar. 10, 2020

(54) HEAT EXCHANGES WITH INSTALLATION FLEXIBILITY

(71) Applicant: Hamilton Sundstrand Corporation, Charlotte, NC (US)

(72) Inventors: Neal R. Herring, East Hampton, CT (US); Brian St. Rock, Andover, CT (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 0 days.

(21) Appl. No.: 15/438,893

(22) Filed: Feb. 22, 2017

(65) Prior Publication Data

US 2018/0238627 A1 Aug. 23, 2018

(51) Int. Cl.

| | |
|---|---|
| ***F28D 7/00*** | (2006.01) |
| ***F28F 1/02*** | (2006.01) |
| ***F28F 7/02*** | (2006.01) |
| ***F28F 13/08*** | (2006.01) |
| *F02B 29/04* | (2006.01) |
| *F28D 9/00* | (2006.01) |

(52) U.S. Cl.

CPC ..... *F28D 7/0008* (2013.01); *F28D 7/0016* (2013.01); *F28F 1/025* (2013.01); *F28F 7/02* (2013.01); *F28F 13/08* (2013.01); *F02B 29/0462* (2013.01); *F02B 29/0475* (2013.01); *F28D 9/0018* (2013.01)

(58) Field of Classification Search

CPC .... F28D 7/0008; F28D 7/0016; F28D 9/0018; F28D 9/0025; F28D 9/04; F28F 1/025; F02B 29/04; F02B 29/0462; F02B 29/0475

USPC ..... 165/165, 157, 42, 43, 166

See application file for complete search history.

(56) References Cited

U.S. PATENT DOCUMENTS

| | | | | |
|---|---|---|---|---|
| 4,469,078 | A * | 9/1984 | Speer | F02B 37/164 123/564 |
| 4,898,234 | A | 2/1990 | McGovern et al. | |
| 5,002,123 | A | 3/1991 | Nelson et al. | |
| 5,242,015 | A | 9/1993 | Saperstein et al. | |
| 7,111,673 | B2 | 9/2006 | Hugill | |
| 7,285,153 | B2 * | 10/2007 | Bruun | F23C 13/00 165/165 |
| 7,661,460 | B1 * | 2/2010 | Cowans | F28D 7/024 165/140 |
| 7,871,578 | B2 | 1/2011 | Schmidt | |

(Continued)

FOREIGN PATENT DOCUMENTS

| | | |
|---|---|---|
| EP | 3193116 | 7/2017 |
| SK | 1222014 | 3/2015 |

OTHER PUBLICATIONS

EP Application No. 18156907.0 Extended EP Search Report dated Jun. 26, 2018, 6 pages.

*Primary Examiner* — Joel M Attey
(74) *Attorney, Agent, or Firm* — Cantor Colburn LLP

(57) ABSTRACT

A heat exchanger includes a body shaped to integrate with one or more system structural elements and a plurality of first flow channels defined in the body. The heat exchanger also includes a plurality of second flow channels defined in the body. The second flow channels are fluidly isolated from the first flow channels. The first flow channels and the second flow channels have a changing flow direction characteristic along a direction of flow within the first flow channels and the second flow channels.

13 Claims, 9 Drawing Sheets

(56) References Cited

U.S. PATENT DOCUMENTS

| | | | | |
|---|---|---|---|---|
| 9,010,405 | B1 | 4/2015 | Bharathan et al. | |
| 9,134,072 | B2 | 9/2015 | Roisin et al. | |
| 2003/0173720 | A1 | 9/2003 | Musso et al. | |
| 2004/0258587 | A1* | 12/2004 | Bowe | B01J 19/249 422/222 |
| 2008/0040984 | A1 | 2/2008 | Lanahan | |
| 2010/0300666 | A1 | 12/2010 | Hislop et al. | |
| 2013/0206374 | A1* | 8/2013 | Roisin | B22F 7/002 165/165 |
| 2014/0174703 | A1* | 6/2014 | Yoshioka | F28D 7/0033 165/173 |
| 2016/0123230 | A1 | 5/2016 | Thomas | |
| 2016/0202003 | A1 | 7/2016 | Gerstler et al. | |
| 2016/0230595 | A1* | 8/2016 | Wong | F28F 3/02 |
| 2016/0231071 | A1 | 8/2016 | Sekol et al. | |
| 2017/0191762 | A1* | 7/2017 | Duesler | F02C 7/12 |
| 2017/0198977 | A1 | 7/2017 | Herring et al. | |
| 2017/0198978 | A1 | 7/2017 | Kuczek et al. | |
| 2017/0248372 | A1* | 8/2017 | Erno | F28F 9/0275 |

* cited by examiner

HEAT EXCHANGES WITH INSTALLATION FLEXIBILITY

BACKGROUND

The present disclosure relates to heat exchangers, more specifically to more thermally efficient heat exchangers with installation flexibility.

Conventional plate fin heat exchanger cores are typically constructed out of flat sheet metal parting sheets, spacing bars, and two-dimensional thin corrugated fins brazed together. The fabrication process is well established and relatively simple. However, the manufacturing simplicity can have a negative impact on performance and installation options. Conventional heat exchanger channel geometry is two-dimensional and does not allow for streamwise geometry variation that has an impact on flow distribution, heat transfer, and pressure drop. In addition, the integrity of the structure is limited by the strength and quality of the braze joints which may be subject to stress concentration since there is no mechanism to control the size of the corner fillets. Flat geometry of the parting sheets exposed to high pressure causes bending, so thicker plates are used to reduce the stress level at expense of the weight. Traditional plate fin construction imposes multiple design constraints that can inhibit performance, increase size and weight, suffer structural reliability issues, and limit system integration opportunities. Conventional plate-fin heat exchangers are typically designed to maximize thermal conductivity, which severely limits material selection options.

BRIEF DESCRIPTION

According to one embodiment a heat exchanger includes a body shaped to integrate with one or more system structural elements and a plurality of first flow channels defined in the body. The heat exchanger also includes a plurality of second flow channels defined in the body. The second flow channels are fluidly isolated from the first flow channels. The first flow channels and the second flow channels have a changing flow direction characteristic along a direction of flow within the first flow channels and the second flow channels.

In addition to one or more of the features described above, or as an alternative, further embodiments may include where the changing flow direction characteristic of the first and second flow channels comprises a changing cross-sectional shape of the body.

In addition to one or more of the features described above, or as an alternative, further embodiments may include where the changing flow direction characteristic includes a flow direction such that the body includes a non-planar twisting shape comprising one or more curves.

In addition to one or more of the features described above, or as an alternative, further embodiments may include where the body is shaped conformal to fit between two or more system elements.

In addition to one or more of the features described above, or as an alternative, further embodiments may include where the body is shaped to transfer heat and transport a fluid between at least two system elements.

In addition to one or more of the features described above, or as an alternative, further embodiments may include where the at least two system elements include at least two flow streams.

In addition to one or more of the features described above, or as an alternative, further embodiments may include where the body is shaped conformal to at least partially wrap around at least one system element.

In addition to one or more of the features described above, or as an alternative, further embodiments may include where the body includes one or more cavities to route a portion of at least one system element through the body in contact with a subset of the first and second flow channels.

In addition to one or more of the features described above, or as an alternative, further embodiments may include where the at least one system element includes a pipe that is fluidly isolated from the first and second flow channels.

In addition to one or more of the features described above, or as an alternative, further embodiments may include where the at least one system element includes one or more structural supports.

In addition to one or more of the features described above, or as an alternative, further embodiments may include where the body is a first body and the heat exchanger further includes a second body including a second plurality of the first and second flow channels.

In addition to one or more of the features described above, or as an alternative, further embodiments may include where the first body and the second body are physically joined as separate layers of the heat exchanger.

In addition to one or more of the features described above, or as an alternative, further embodiments may include where the first body and the second body include separate heat exchanger modules physically separated and fluidly coupled by one or more headers.

In addition to one or more of the features described above, or as an alternative, further embodiments may include where the first flow channels have a first flow area that differs from a second flow area of the second flow channels at a same cross-section of the body.

In addition to one or more of the features described above, or as an alternative, further embodiments may include where the one or more system structural elements comprise one or more of: a flow duct, a scoop, a cowl, and/or a curved engine component.

According to an embodiment, a method for manufacturing a heat exchanger includes forming a body shaped to integrate with one or more system structural elements. The body includes a plurality of first flow channels and a plurality of second flow channels such that the second flow channels are fluidly isolated from the first flow channels, and such that the first flow channels and the second flow channels have a changing flow direction characteristic along a direction of flow within the first flow channels and the second flow channels.

In addition to one or more of the features described above, or as an alternative, further embodiments may include where the body is shaped conformal to at least partially wrap around at least one system element and/or fit between two or more system elements.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter which is regarded as the present disclosure is particularly pointed out and distinctly claimed in the claims at the conclusion of the specification. The foregoing and other features, and advantages of the present disclosure are apparent from the following detailed description taken in conjunction with the accompanying drawings in which:

DETAILED DESCRIPTION

Figure 1A:
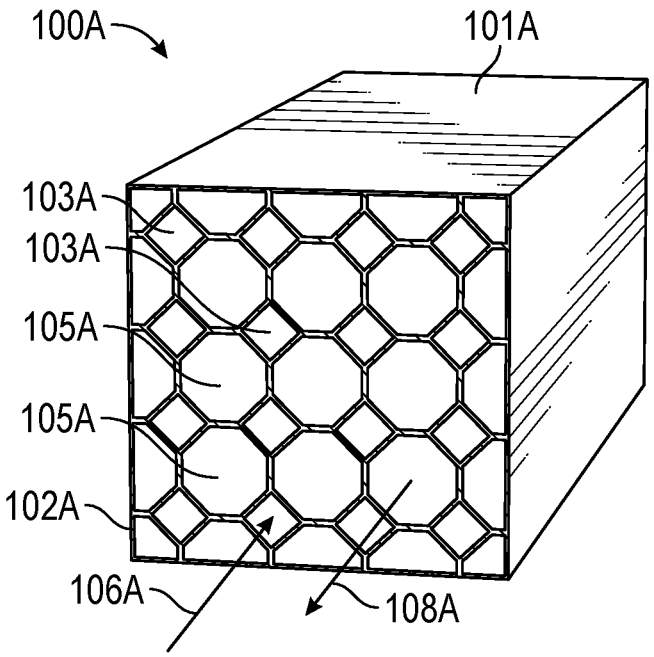
FIG. 1A is a perspective cross-sectional view of an embodiment of a heat exchanger, showing hot and cold flow channels in the body of the heat exchanger in accordance with this disclosure.

A detailed description of one or more embodiments of the disclosed systems and methods are presented herein by way of exemplification and not limitation with reference to the Figures. For purposes of explanation and illustration, and not limitation, illustrative views of embodiments of heat exchangers in accordance with the disclosure are shown in FIGS. 1A, 1B, 1C, and 1D and are designated generally by reference characters 100A, 100B, 100C, and 100D respectively. Other embodiments and/or aspects of this disclosure are shown in FIGS. 2-13. The systems and methods described herein can be used to reduce weight and/or increase performance of heat transfer systems.

Referring to FIG. 1A, a heat exchanger 100A includes a body 101A, a plurality of first flow channels, e.g., hot flow channels 103A as described herein, defined in the body 101A, and a plurality of second flow channels, e.g., cold flow channels 105A as described herein, defined in the body 101A. While hot flow channels 103A and the cold flow channels 105A are described with respect to a relative temperature of flow therein, it is contemplated that the hot flow channels 103A can be used for cold flow and vice versa, or any other suitable arrangement. In the example of FIG. 1A, the hot flow channels 103A provide a fluid flow path for a hot flow 106A, and the cold flow channels 105A provide a fluid flow path for a cold flow 108A. In embodiments, the flow direction of the hot flow 106A is opposite of the cold flow 108A; however, the hot flow 106A and the cold flow 108A can be substantially parallel to each other at cross-section 102A and may have different flow rates.

The cold flow channels 105A are fluidly isolated from the hot flow channels 103A. The hot flow channels 103A and the cold flow channels 105A can have a changing flow direction characteristic along a direction of flow within the hot flow channels 103A and the cold flow channels 105A. The changing flow direction characteristic can result, for example, from an overall non-planar twisting of the body 101A, routing of the body 101A to fit between two or more system elements, the wrapping of the body 101A about one or more system elements, one or more cavities formed within the body 101A to route a portion of at least one system element through the body 101A, and/or variations in flow area and cross-sectional variations of the body 101A. The body 101A can be made of any other suitable material resulting in a substantially rigid structure.

Figure 1B:
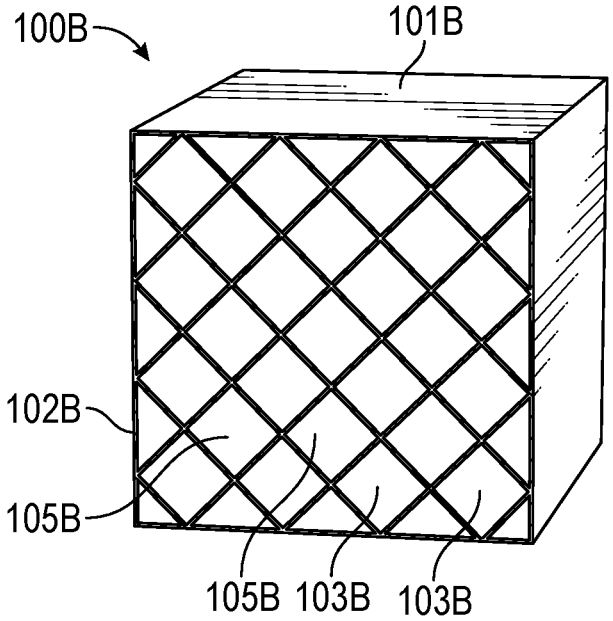
FIG. 1B is a perspective cross-sectional view of a heat exchanger, showing hot and cold flow channels in the body of the heat exchanger in accordance with this disclosure.
Figure 1C:
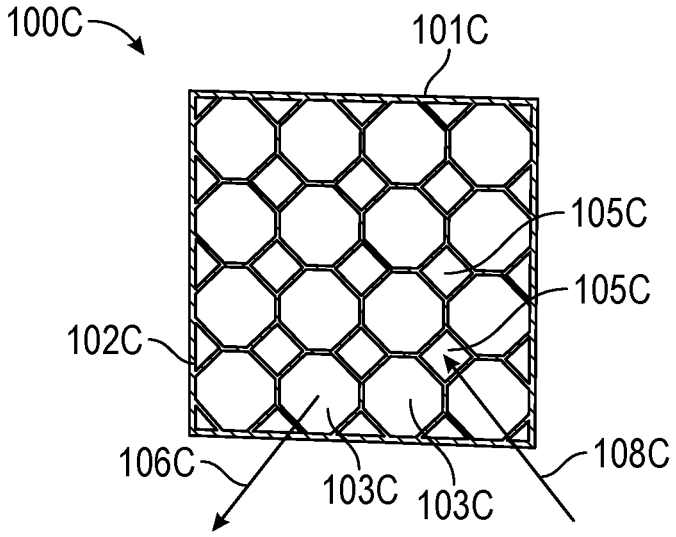
FIG. 1C is a cross-sectional view of a heat exchanger, showing hot and cold flow channels in the body of the heat exchanger in accordance with this disclosure.
Figure 1D:
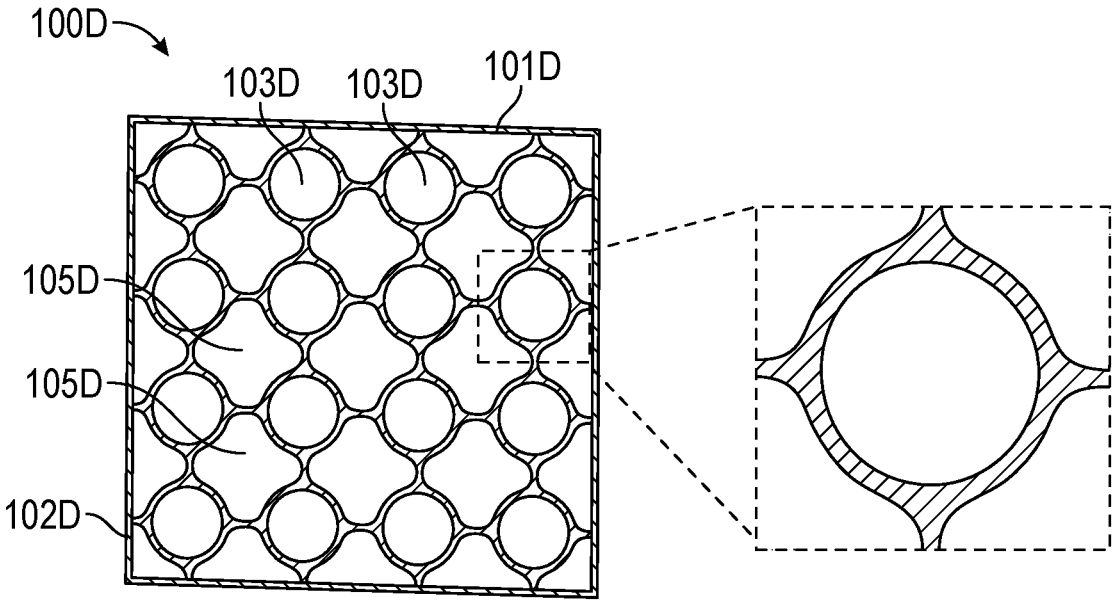
FIG. 1D is a cross-sectional view of a heat exchanger, showing hot and cold flow channels in the body of the heat exchanger in accordance with this disclosure.

FIGS. 1B, 1C, and 1D illustrate several example configurations with similar elements as described in reference to heat exchanger 100A of FIG. 1A. Cross-section 102B of heat exchanger 100B illustrates that hot flow channels 103B and cold flow channels 105B can have a substantially equivalent shape and size in one or more portions of body 101B of the heat exchanger 100B. However, relative sizing, positioning, curvature, cross-sectional shape, and/or area may change at different cross-sectional locations of the heat exchanger 100B. In the example of FIG. 1C, cross-section 102C of body 101C of heat exchanger 100C can have a substantially opposite distribution of hot flow channels 103C and cold flow channels 105C for receiving a hot flow 106C and delivering a cold flow 108C as compared to the cross-section 102A of FIG. 1A. In the example of FIG. 1D, heat exchanger 100D can include a body 101D defining elliptical hot flow channels 103D and non-elliptical cold flow channels 105D at cross-section 102D, where channels 103D, 105D can include one or more changing flow direction characteristics as described hereinabove and/or described below. Any other suitable flow area shapes for the hot flow channels 103A-D and/or the cold flow channels 105A-D are contemplated herein.

In certain embodiments, the changing flow direction characteristic of the hot and/or cold flow channels 103A-D/105A-D can include a changing flow area shape, introduction of secondary area, a waviness characteristic, a twisting characteristic, and the like. In certain embodiments, a changing flow area shape can include a first flow area at a hot flow inlet (e.g., a diamond as shown in FIG. 1A) which transitions through an intermediate hot flow channel to a second flow area having more sides at a hot flow outlet (e.g., an octagon as shown in FIG. 1C). Also as shown, the changing flow area shape can include a first flow area at a cold flow inlet (e.g., a diamond as shown in FIG. 1C) which transitions through an intermediate cold flow channel to a second flow area having more sides at a cold flow outlet (e.g., an octagon as shown in FIG. 1A).

Figure 2:
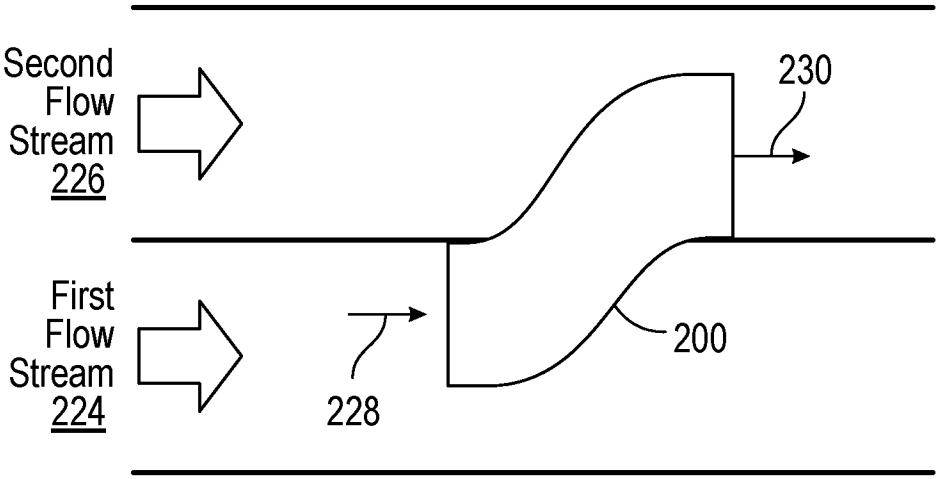
FIG. 2 depicts a heat exchanger that acts as a duct integrated between flow streams in accordance with this disclosure.

FIG. 2 depicts a heat exchanger 200 integrated between a first flow stream 224 and a second flow stream 226 in accordance with this disclosure. The heat exchanger 200 can include a same cross-section or a varying cross-section consistent with the examples of FIGS. 1A-1D and/or other embodiments further described herein. For instance, a first portion of air 228 from a fan stream of a gas turbine engine (not depicted) can be passed from the first flow stream 224 to the second flow stream 226 as an outlet flow 230 with heat transfer occurring therein while changing a flow direction characteristic. The substantially "S" shaped heat exchanger 200 can be integrated in a duct or wall between the first flow stream 224 and the second flow stream 226. The heat exchanger 200 can be used for engine bleed air cooling and/or pressure diffusion, for instance. The heat exchanger 200 therefore not only provides heating/cooling but also acts directly as a fluid transfer duct to further reduce overall system component count.

Figure 3:
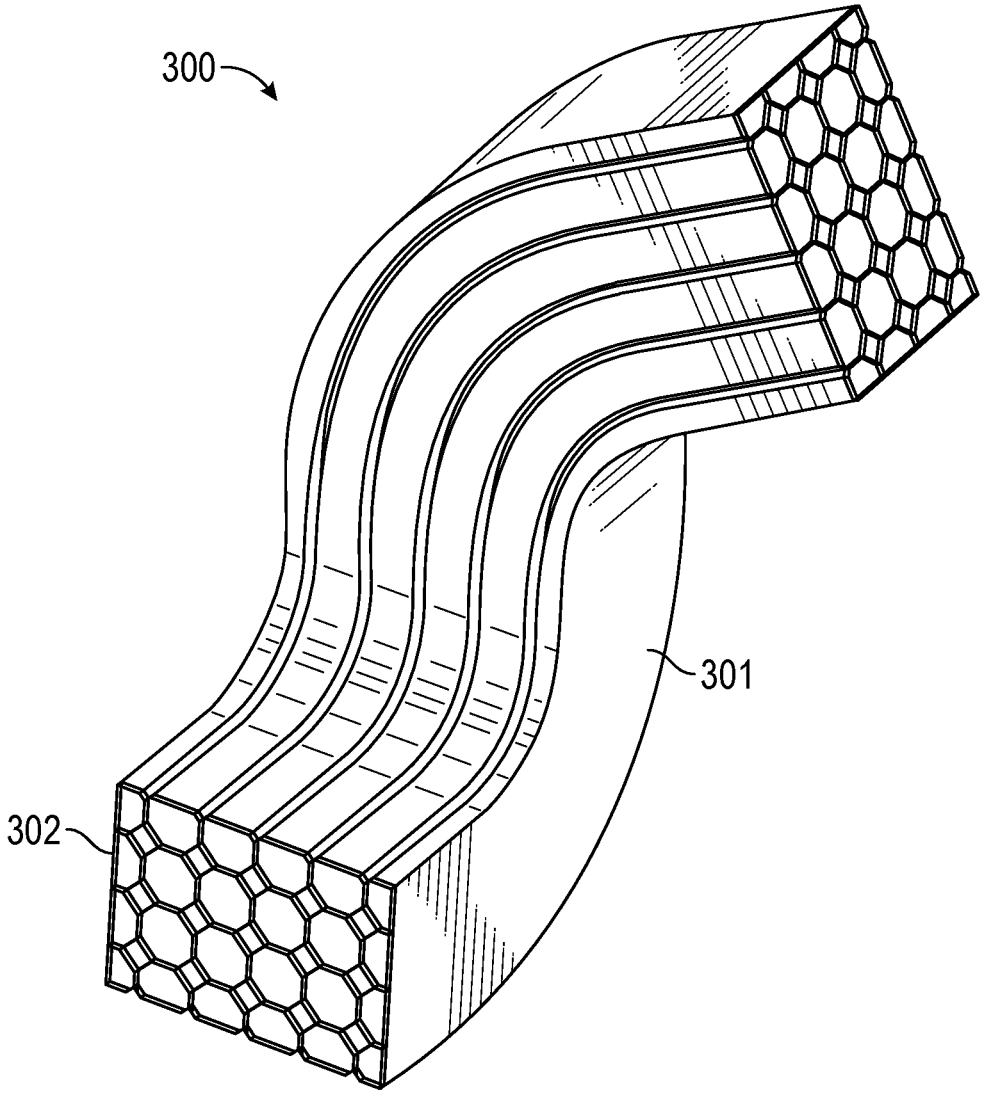
FIG. 3 is a perspective cross-sectional view of an embodiment of a heat exchanger formed with a non-planar twisting body configuration in accordance with this disclosure.

Referring to FIG. 3, the changing flow direction characteristic can include a flow direction variation such that the body 301 of heat exchanger 300 includes a twisting shape to bend between two locations with different orientations. In certain embodiments, the twisting shape can include one or more curves. For example, as shown, the one or more curves can cause the turning shape to be non-planar (e.g., such that the twisting shape turns/bends in three dimensions). The twisting shape can be used to not only provide cooling but also acts as a transfer duct between non-linearly aligned system elements with differing orientation and/or interface shapes/sizes.

In such embodiments, the body 301 can be designed for specific special constraints of an intended system of use (e.g., to minimize volume of the entire system). Any other suitable shape for the body 301 is contemplated herein including changes in area at each end of the body 301 to match corresponding fluid inlet/outlet interfaces or headers.

It is contemplated that a heat exchanger 100A-D, 200, 300 can include any suitable header (not shown) configured to connect the hot flow channels 103A-D to a hot flow source (not shown) while isolating the hot flow channels 103A-D from the cold flow channels 105A-D. The header may be formed monolithically with the core of the heat exchanger 100A-D, 200, 300, or otherwise suitably attached to cause the hot flow channels 103A-D to converge together and/or to cause the cold flow channels 105A-D to converge together.

Figure 4:
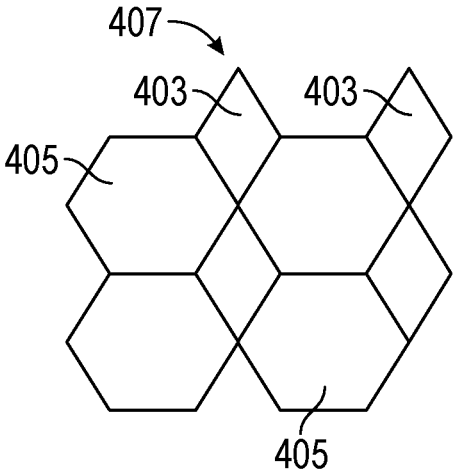
FIG. 4 is a cross-sectional view of repeating elements within a heat exchanger core for installation flexibility in accordance with this disclosure.
Figure 5:
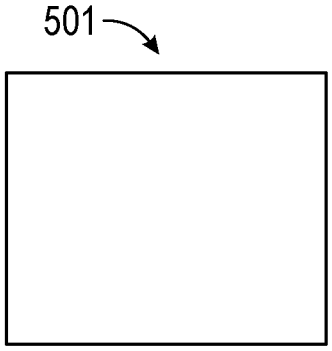
FIG. 5 depicts a frontal or cross-sectional shape of a heat exchanger in accordance with this disclosure.
Figure 6:
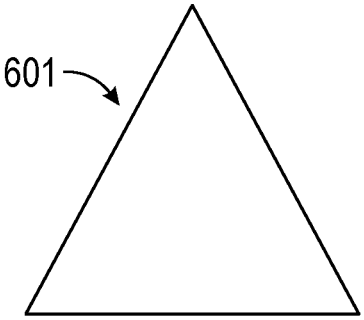
FIG. 6 depicts another frontal or cross-sectional shape of a heat exchanger in accordance with this disclosure.
Figure 7:
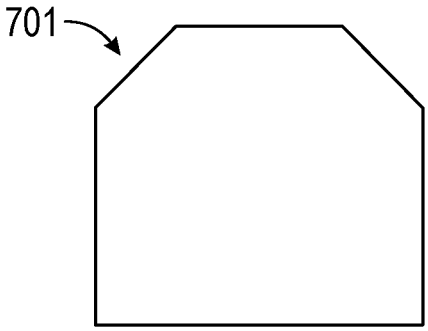
FIG. 7 depicts an alternate frontal or cross-sectional shape of a heat exchanger in accordance with this disclosure.

As depicted in the further example of FIG. 4, first flow channels 403 and second flow channels 405 of heat exchanger 100A-D, 200, 300 of FIGS. 1A-D, 2, 3 may also or alternately include a hexagon shape, a diamond shape, circular, elliptical, or other regular/irregular shapes as repeating elements 407 which can vary or remain consistent along the length of each respective flow channel 403, 405. As another example, a changing characteristic of the first and/or second flow channels 403, 405 can include a changing cross-sectional shape while changing or maintaining a same cross-sectional area of the body. For instance, a heat exchanger can include a rectangular cross-section, such as cross-section 302 of heat exchanger 300 of FIG. 3, and may remain constant or transition between one or more shapes having various angles, side length ratios, curvature and/or number of sides. Examples include a rectangular shape 501 of FIG. 5, a triangular shape 601 of FIG. 6, a cut-corner rectangular shape 701 of FIG. 7, and other arbitrary shapes. As another example, a heat exchanger can have a first front shape that is a triangular shape 601, which may transition to a rectangular shape 501, and have a second front shape that is a cut-corner rectangular shape 701 (i.e., with six sides). In this example, each of the shapes 501, 601, 701 can change or maintain a same cross-sectional area as the cross-sectional shapes change. Thus, the front shape or any cross-sectional shape of a heat exchanger need not be limited to the rectangular shape 501 but can also be any shape with fewer than four sides or greater than four sides according to embodiments.

Figure 8:
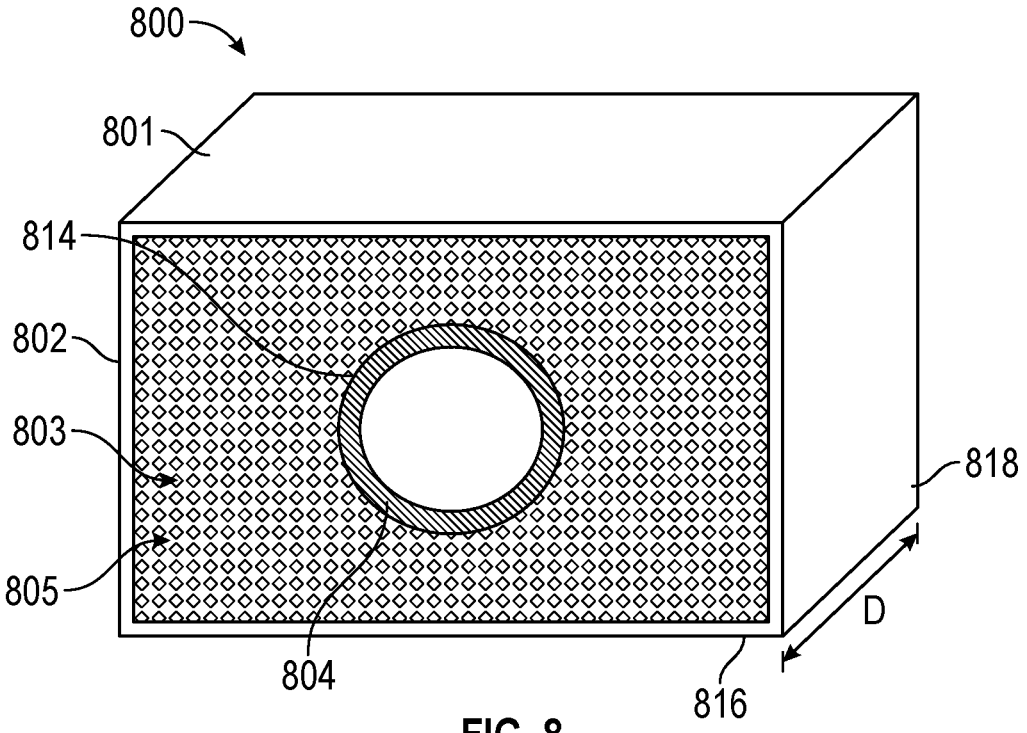
FIG. 8 is a perspective cross-sectional view of a pipe routed through a heat exchanger in accordance with this disclosure.

FIG. 8 is a perspective cross-sectional view of a pipe 804 routed through one or more cavities 814 of a heat exchanger 800 between a first side 816 and a second side 818 of the heat exchanger 800. The first side 816 may be a front side of the heat exchanger 800 and is generally depicted at a cross-section 802 that spans a linear distance D between the first side 816 and the second side 818. The one or more cavities 814 need not be linear and can be formed of one or more arbitrary shapes within the body 801 of the heat exchanger 800 to support bends, junctions, and the like in routing the pipe 804 and/or other systems elements, such as one or more structural supports, through the heat exchanger 800. In the example of FIG. 8, the pipe 804 is fluidly isolated from first flow channels 803 (e.g., hot flow channels) and second flow channels 805 (e.g., cold flow channels) formed in the body 801 of heat exchanger 800. Forming the heat exchanger 800 around one or more system elements, such as pipe 804, can enable tighter overall packaging, as well as multiple heat transfer and fluid transport options. Alternative, the body 801 or a portion thereof may be shaped conformal to fit between two or more system elements and need not be rectangular/box shaped.

Figure 9:
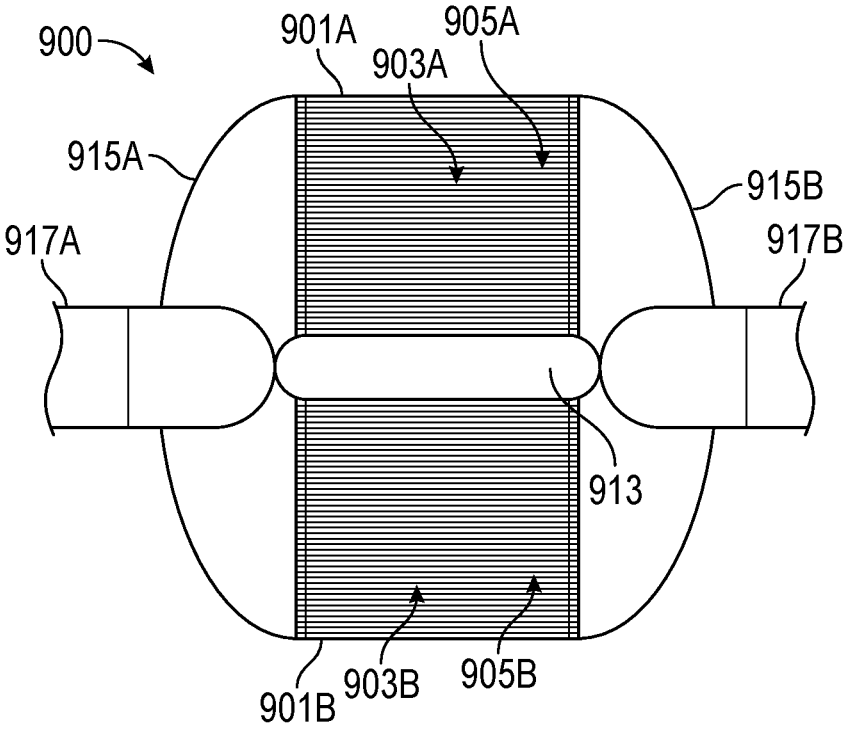
FIG. 9 depicts modular heat exchanger elements in accordance with this disclosure.

FIG. 9 depicts a heat exchanger 900 formed of a first body 901A and a second body 901B as modular heat exchanger elements in accordance with this disclosure. The first body 901A includes a first plurality of first flow channels 903A (e.g., hot flow channels) and second flow channels 905A (e.g., cold flow channels). The second body 901B includes a second plurality of first flow channels 903B (e.g., hot flow channels) and second flow channels 905B (e.g., cold flow channels). The first body 901A and the second body 901B can be separate heat exchanger modules physically separated by a stress relief region 913 and fluidly coupled by one or more headers 915A, 915B. In the example of FIG. 9, a hot fluid can flow from inlet pipe 917A through header 915A to both first and second bodies 901A, 901B (e.g., through first flow channels 903A, 903B) to header 915B and outlet pipe 917B. A cooling fluid, such as an air flow can pass through the second flow channels 905A, 905B, for instance, substantially parallel and in an opposite direction with respect to a heated flow passing from pipes 917A, 917B. The use of multiple bodies 901A, 901B can support flexible packaging of heat exchangers and ease manufacturing burdens for larger heat transfer demand environments.

Figure 10:
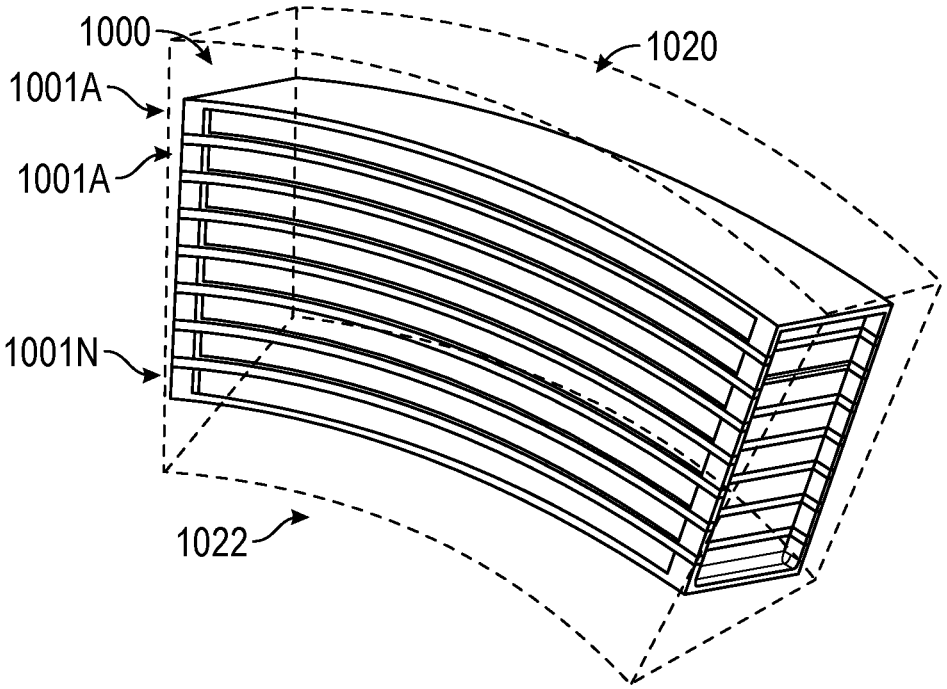
FIG. 10 depicts a perspective view of a conformal heat exchanger in accordance with this disclosure.

FIG. 10 depicts a perspective view of a conformal heat exchanger 1000 in accordance with this disclosure. The heat exchanger 1000 can include multiple bodies 1001A, 1001B, . . . , 1001N that may be physically joined as separate layers of the heat exchanger 1000. The bodies 1001A-1001N are shaped to integrate with one or more system structural elements 1020, such as a flow duct, a scoop, a cowl, and/or a curved engine component. A base curvature 1022 of the heat exchanger 1000 can be formed to wrap about a portion of a system structural element, such as an engine housing of a gas turbine engine, or radial turbomachinery in an air cycle machine, or wrap entirely around a substantially cylindrical body, for instance.

Figure 11:
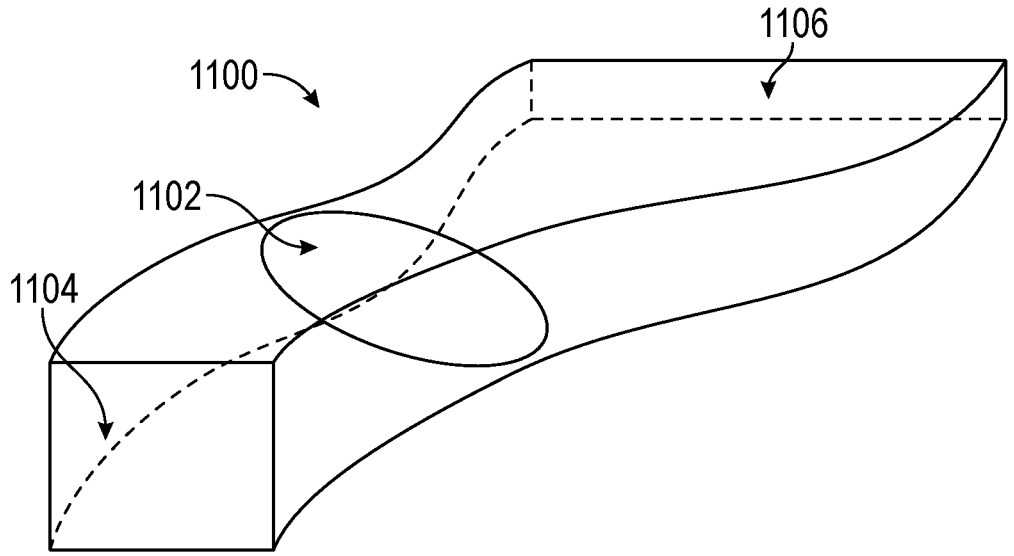
FIG. 11 depicts a perspective view of a heat exchanger with a changing overall cross-section along a flow path in accordance with this disclosure.
Figure 12:
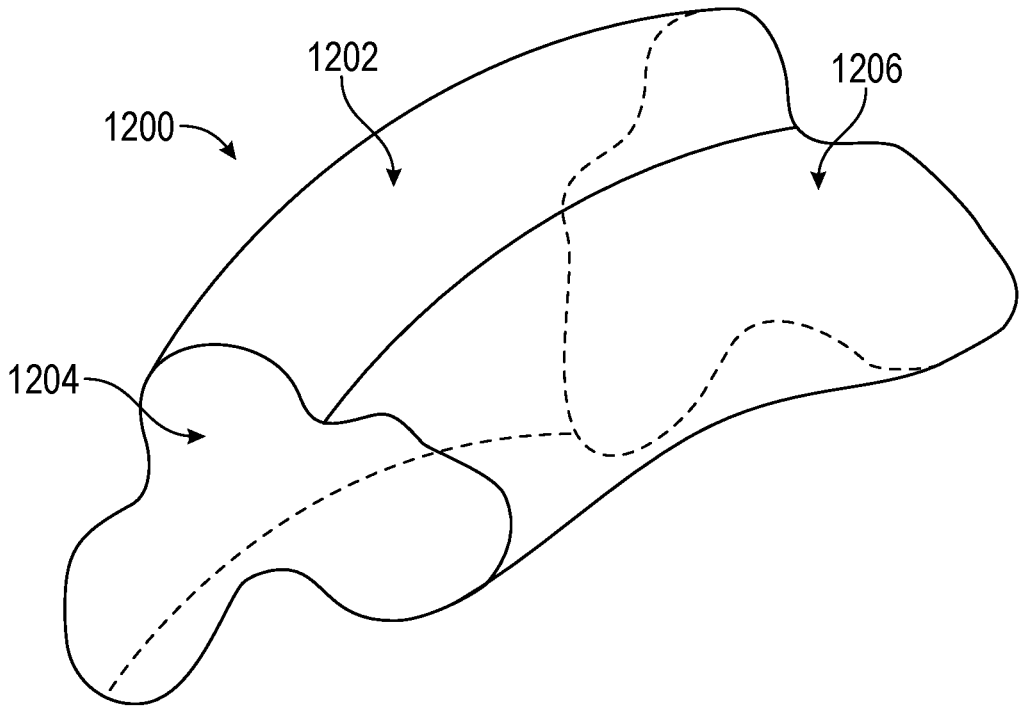
FIG. 12 depicts a perspective view of a heat exchanger with an amorphous cross-section along a flow path in accordance with this disclosure.
Figure 13:
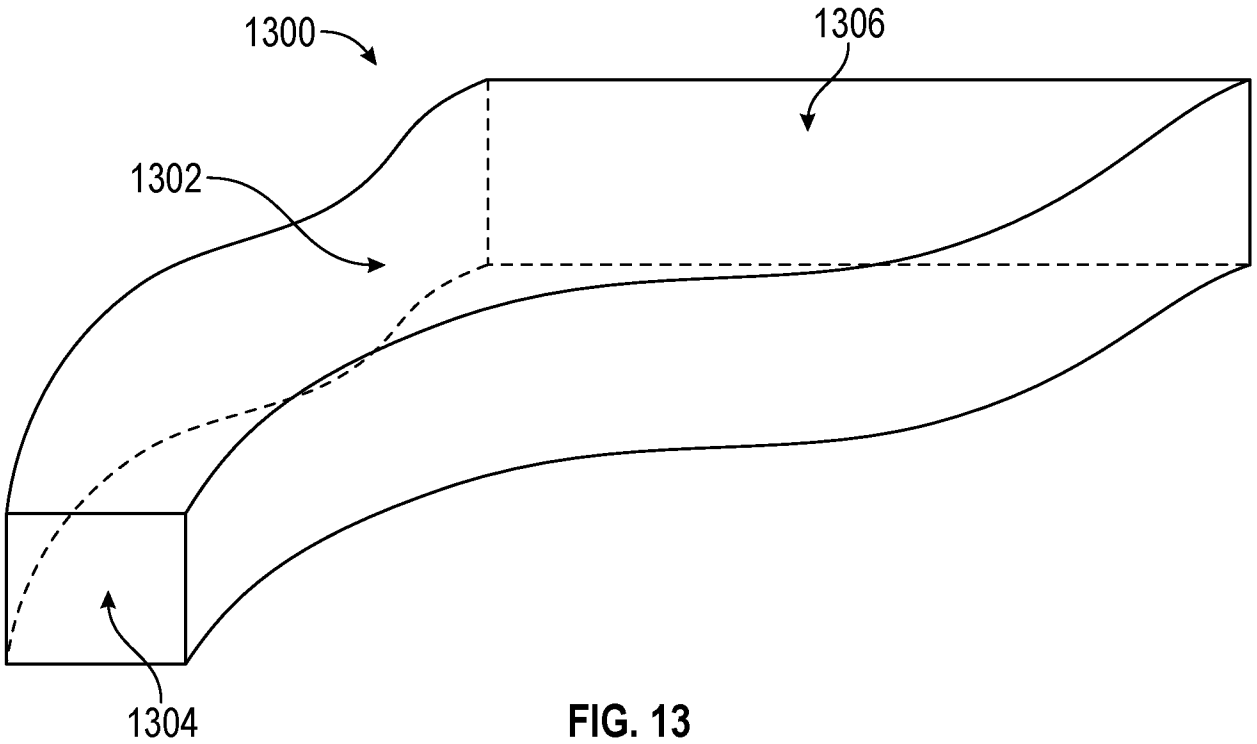
FIG. 13 depicts a perspective view of a heat exchanger with a changing overall cross-section shape and area along a flow path in accordance with this disclosure.

FIGS. 11, 12, and 13 depict further examples of heat exchangers 1100, 1200, and 1300 respectively. The heat exchanger 1100 has a changing overall cross-section 1102 between a first end 1104 and a second end 1106. The ability to gradually change cross-sectional shape and/or area along a flow path within the heat exchanger 1100 can support interface and routing variations within the heat exchanger 1100 without requiring additional ductwork. The heat exchanger 1200 has an amorphous cross-section 1202 along a flow path between a first end 1204 and a second end 1206. Although depicted as having a substantially constant shape of cross-section 1202, in some embodiments, the cross-section 1202 can vary in shape and/or area between the first and second ends 1204, 1206. The heat exchanger 1300 of FIG. 13 is an example of a changing overall cross-section shape 1302 and area along a flow path between a first end 1304 and a second end 1306. It will be understood that further variations having various shape profiles and overall curvature variations are contemplated herein.

Referring back to the example of FIG. 1, in accordance with at least one aspect of this disclosure, a method for manufacturing a heat exchanger 100A-D includes forming a body 101A-D shaped to integrate with one or more system structural elements, such as system structural elements 1020 of FIG. 10. The body 101A-D is formed to include a plurality of hot flow channels 103A-D and a plurality of cold flow channels such that the cold flow channels 105A-D are fluidly isolated from the hot flow channels 103A-D, and such that the hot flow channels 103A-D and the cold flow channels 105A-D have a changing flow direction characteristic along a direction of flow within the hot flow channels 103A-D and the cold flow channels 105A-D. In certain embodiments, the forming of the heat exchanger 100A-D can include additively manufacturing the heat exchanger 100 using any suitable method (e.g., powder bed fusion, electron beam melting) and/or manufacturing by extrusion or a lamination process. The body 101A-D can be shaped to transfer heat and transport a fluid between at least two system elements.

Additively manufacturing the heat exchanger 100A-D can include monolithically forming the body 101A-D to have a twisting shape. Monolithically forming the body 101A-D to have a twisting shape can include monolithically forming the body 101A-D to be non-planar (e.g., as shown in FIG. 3) with one or more curves.

Embodiments as described above allow for enhanced control of flow therethrough, a reduction of pressure drop, control of thermal stresses, easier integration within a system, and reduced volume and weight. Unlike conventional plate-fin heat exchanger cores, embodiments as described above allow for channel size adjustment for better flow impedance match across the core. Also, embodiments allow the geometry of the core to be twisted or bent to better fit available space as desired from a system integration perspective.

Further, in additively manufactured embodiments, since the core is made out of a monolithic material, the material can be distributed to optimize heat exchange and minimize structural stresses, thus minimizing the weight. Example materials include various plastics, aluminum, titanium, and/or nickel alloys, for instance. Bending stresses generated by high pressure difference between cold and hot side can be greatly reduced by adjusting curvature of the walls and appropriately sizing comer fillets. Such solution reduces weight, stress, and material usage since the material distribution can be optimized and since the material works in tension instead of bending.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof.

The methods and systems of the present disclosure, as described above and shown in the drawings, provide for heat exchangers with superior integrated system properties including reduced volume, weight, and/or increased efficiency. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A heat exchanger comprising:

a body integrated with one or more system structural elements having a non-planar shape wherein the one or more system structural elements comprise one or more of: a flow duct, a scoop, a cowl, an engine housing, radial turbomachinery, and/or a curved engine component;

a plurality of first flow channels defined in the body; and a plurality of second flow channels defined in the body, the second flow channels fluidly isolated from the first flow channels, wherein the first flow channels and the second flow channels have a changing flow direction characteristic along a direction of flow within the first flow channels and the second flow channels, wherein the body comprises one or more cavities to route a portion of one or more structural supports through the body in contact with a subset of the first and second flow channels.

2. The heat exchanger of claim 1, wherein the changing flow direction characteristic of the first and second flow channels comprises a changing cross-sectional shape of the body.

3. The heat exchanger of claim 1, wherein the one or more system structural elements comprises a pipe that is fluidly isolated from the first and second flow channels.

4. The heat exchanger of claim 1, wherein the body is a first body and the heat exchanger further comprises a second body including a second plurality of the first and second flow channels.

5. The heat exchanger of claim 4, wherein the first body and the second body are physically joined as separate layers of the heat exchanger.

6. The heat exchanger of claim 4, wherein the first body and the second body comprise separate heat exchanger modules physically separated and fluidly coupled by one or more headers.

7. The heat exchanger of claim 1, wherein the first flow channels have a first flow area that differs from a second flow area of the second flow channels at a same cross-section of the body.

8. The heat exchanger of claim 1, further comprising a header, wherein the body, the first flow channels, and the second flow channels form a core of the heat exchanger that is monolithically formed with the header.

9. The heat exchanger of claim 1, wherein the changing flow direction characteristic comprises a flow direction such that the body includes a non-planar twisting shape comprising one or more curves.

10. A method for manufacturing a heat exchanger, the method comprising:

forming a body integrated with one or more system structural elements having a non-planar shape, wherein the one or more system structural elements comprise one or more of: a flow duct, a scoop, a cowl, an engine housing, radial turbomachinery, and/or a curved engine component, the body comprising a plurality of first flow channels and a plurality of second flow channels such that the second flow channels are fluidly isolated from the first flow channels, and such that the first flow channels and the second flow channels have a changing flow direction characteristic along a direction of flow within the first flow channels and the second flow channels, wherein the body comprises one or more cavities to route a portion of one or more structural supports through the body in contact with a subset of the first and second flow channels.

11. The method of claim 10, wherein the changing flow direction characteristic of the first and second flow channels comprises a changing cross-sectional shape of the body.

12. The method of claim 10, wherein the one or more system structural elements comprise a pipe that is fluidly isolated from the first and second flow channels.

13. The method of claim 10, wherein the changing flow direction characteristic comprises a flow direction such that the body includes a non-planar twisting shape comprising one or more curves.

* * * * *